US010306966B2

(12) United States Patent
Sumerville et al.

(10) Patent No.: US 10,306,966 B2
(45) Date of Patent: Jun. 4, 2019

(54) APPARATUS FOR HAIR COOLING AND DEHUMIDIFICATION

(71) Applicant: Tight & Right Hair Revolution, Inc., Baltimore, MD (US)

(72) Inventors: Larry Maurice Sumerville, Baltimore, MD (US); Tumajah Vernet Sumerville, Baltimore, MD (US)

(73) Assignee: Tight & Right Hair Revolution, Inc., Lewes, DE (US)

( * ) Notice: Subject to any disclaimer, the term of this patent is extended or adjusted under 35 U.S.C. 154(b) by 194 days.

(21) Appl. No.: 15/593,416

(22) Filed: May 12, 2017

(65) Prior Publication Data

US 2018/0000218 A1 Jan. 4, 2018

Related U.S. Application Data

(60) Provisional application No. 62/495,586, filed on May 14, 2016.

(51) Int. Cl.

| | |
|---|---|
| ***A45D 20/20*** | (2006.01) |
| ***A45D 20/08*** | (2006.01) |
| ***F24F 5/00*** | (2006.01) |
| ***F24F 3/14*** | (2006.01) |

(52) U.S. Cl.

CPC ..... *A45D 20/20* (2013.01); *A45D 20/08* (2013.01); *F24F 3/1411* (2013.01); *F24F 5/0014* (2013.01); *F24F 5/0042* (2013.01); *F24F 2221/38* (2013.01)

(58) Field of Classification Search

CPC ..... A45D 20/20; A45D 20/08; F24F 3/1411; F24F 5/0014; F24F 5/0042; F24F 2221/38

See application file for complete search history.

(56) References Cited

U.S. PATENT DOCUMENTS

| | | | | |
|---|---|---|---|---|
| 2,505,378 | A * | 4/1950 | Belgau | A45D 20/46 34/99 |
| 2002/0104150 | A1* | 8/2002 | Hill | A42B 1/041 2/174 |
| 2009/0183383 | A1* | 7/2009 | Kroll | A45D 20/22 34/99 |
| 2018/0311515 | A1* | 11/2018 | Wilson | A62B 18/003 |

* cited by examiner

*Primary Examiner* — Jessica Yuen

(74) *Attorney, Agent, or Firm* — Law Offices of John J. Skinner, Jr.; John J. Skinner, Jr.

(57) ABSTRACT

A hair cooling and dehumidification apparatus includes a wearable headgear. The wearable headgear includes an outer layer, an insert layer, and an inner layer. The outer layer includes a supply port. The supply port is in fluid communication with a high-pressure storage tank via a vortex tube. The insert layer, detachably attached to the outer layer, includes a network of ducts and detachable insert elements. The ducts are in fluid communication with the supply port to receive a cooling gas from the vortex tube and distribute the cooling gas to the hair. The detachable insert elements are detachably attached to the insert layer via fasteners. The detachable insert elements, spaced apart to accommodate the network of ducts there between, comprise desiccant materials embedded within for absorbing moisture. The inner layer is proximal to the hair of the user to transfer the cooling gas to the hair.

7 Claims, 7 Drawing Sheets

APPARATUS FOR HAIR COOLING AND DEHUMIDIFICATION

BACKGROUND OF THE INVENTION

A. Technical Field

The present invention relates generally to a hair care apparatus. More particularly, the invention relates to an apparatus for cooling and dehumidifying the hair of a user.

B. Description of Related Art

Hair care, in general, refers to practices and treatments that maintain overall health and hygiene of the hair from a scalp of an individual. Well-maintained hair is integral to the general hygiene and confidence of the individual in a social setting. Salons and hair wellness centers work to provide healthy and aesthetically pleasing hairstyles. Typically, stylists use chemical hair straightening products such as a relaxer to straighten curly hair. The usage of chemical products are harmful to users if it contacts the skin. An apparatus, which allows a user to preserve his/her hairstyle without the application of chemical products, is required. Additionally, their use results in the formation of brittle and easily damaged hair. Over the years, there has been a trend in the hair care industry, especially among the African American community, of moving away from chemical hair straightening products and embracing natural hair. Consequently, the trend has led to a decline in the sale of chemical products. Both women and men sporting long hair prefer natural hair because it allows them the versatility of having curly hair one day and having their hair straightened the next using a curling iron, flat iron, hot comb, or blow dryer. However, women who wish to keep their hair straightened for extended periods find it challenging to do so because of hot and humid conditions, steam from baths or showers, activities that require them to sweat, etc. Unlike Caucasian women, African American and biracial women do not wash their hair every day because their hair does not become oily in the same fashion as Caucasian women. As a result, it is highly desirable for an African-American woman who has straightened hair, to prevent their hair from getting wet until the time comes for them to wash it.

Currently, existing solutions do not allow women to keep their stylized hair free from moisture while showering, exercising, or participating in any other activity. This translates to a lack of exercise, cool showers with a shower cap, comfortless nights, and/or no vigorous activities. Women with straightened hair have to visit a salon to professionally straighten their hair or take time to do it themselves periodically, which costs both money and effort. After having hair straightened without using chemicals, women must take many precautions to preserve straightened hair. Keeping natural hair straight involves staying out of humid environments and avoiding any activity that cause head sweat. This often keeps women from exercising, enjoying long hot showers/baths or even engaging in vigorous passionate sexual experiences. The only other options available to women include, for example, wearing a wig, wearing short hair dues, wearing sports caps, or wearing bands that draw moisture from the scalp but by that time hair roots are already compromised. Women would be glad to embrace an alternative that gives them freedom to keep their hair the way they want it and still do what they want to do. An apparatus, which absorbs moisture or perspiration from the hair to preserve the opted hairstyle of an individual without affecting his/her lifestyle, is required. Such an apparatus provides the individual with the freedom to engage in vigorous activities without affecting their hairstyle.

Hence, there is a need for an apparatus, which allows a user to preserve his/her hairstyle without the application of chemical products. Furthermore, there is a need for an apparatus, which absorbs moisture or perspiration from the hair to preserve the opted hairstyle of an individual without affecting his/her lifestyle.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The hair cooling and dehumidification apparatus, disclosed herein, addresses the above-mentioned need for an apparatus, which allows a user to preserve his/her hairstyle without the application of chemical products. Furthermore, the invention addresses the need for an apparatus, which absorbs moisture or perspiration from the hair to preserve the opted hairstyle of an individual without affecting his/her lifestyle. The hair cooling and dehumidification apparatus for cooling and absorbing moisture of hair of a user comprises a wearable headgear. The wearable headgear comprises an outer layer, an insert layer, and an inner layer. The outer layer comprises a supply port and a charging port. The supply port is in fluid communication with a high-pressure storage tank via a vortex tube. The high-pressure storage tank stores carbon dioxide ($CO_2$) or air. In case the high-pressure storage tank stores $CO_2$, the $CO_2$ in the high-pressure storage tank exists as a liquid, but when released it turns into a gas.

Therefore, by the time the released gas contacts a user's head, the user only feels cool air flow. Alternately, if compressed air is used, the compressed air is in the gaseous state in the tank, not a liquid like $CO_2$. The insert layer is detachably attached to the outer layer. The insert layer comprises a network of ducts and a plurality of detachable insert elements. The network of ducts is in fluid communication with the supply port of the outer layer. The network of ducts receive a cooling gas from the vortex tube and distribute the cooling gas to the hair. The detachable insert elements are detachably attached to the insert layer via fasteners. Each of the detachable insert elements are spaced apart to accommodate the network of ducts there between. Further, each of the detachable insert elements comprise desiccant materials embedded within for absorbing moisture. The inner layer detachably attached to the insert layer, wherein the inner layer is of a breathable material positioned proximal to the hair of the user to transfer the cooling gas to the hair.

For women with straightened hair or hair styles who desire a carefree solution to keep moisture out, the hair cooling and dehumidification apparatus prevents moisture infiltration in hair and allows women the freedom to enjoy life on their terms. The hair cooling and dehumidification apparatus prevents the accumulation of sweat on the scalp of an individual. The primary function is to prevent head sweat in order to preserve hair from getting full of sweat and odors. The hair cooling and dehumidification apparatus benefits women who have natural hair, for example, hair not treated with straightening chemicals such as relaxers, etc. Hair straightened using a device, for example, blow dryer, curling iron, flat iron, hot comb, etc., is also preserved using the hair cooling and dehumidification apparatus. The hair cooling and dehumidification apparatus allows users to save money and time by keeping their hair dry while they exercise, sleep, shower, or participate in other recreational activities. The invention, disclosed herein, allows women to keep their hair dry and intact while giving them an overall better quality of life.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

Figure 1A:
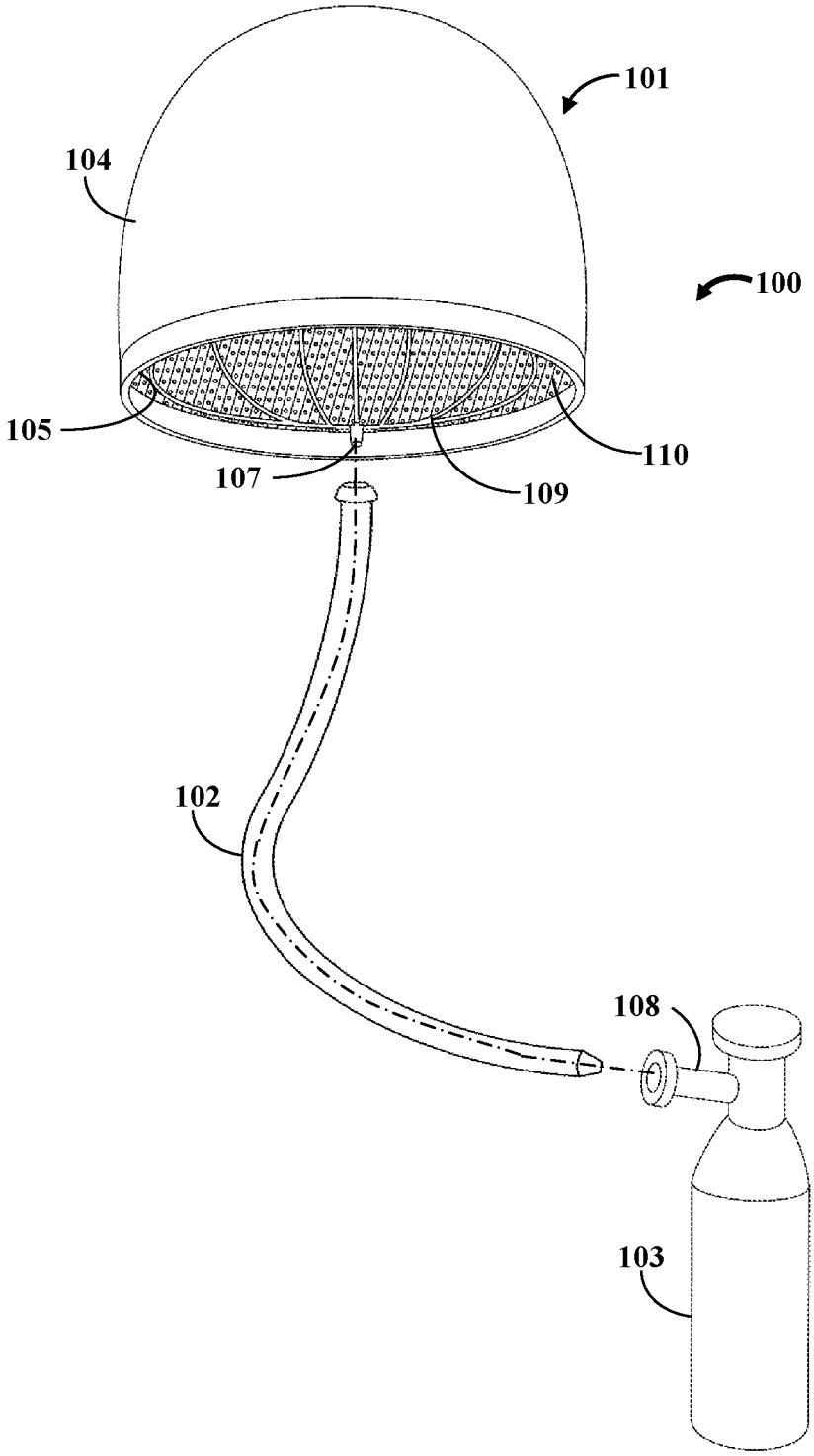
FIG. 1A exemplarily illustrates an exploded view showing components of a hair cooling and dehumidification apparatus.

FIG. 1A exemplarily illustrates an exploded view showing components of a hair cooling and dehumidification apparatus 100. The hair cooling and dehumidification apparatus 100 for cooling and absorbing moisture of hair of a user comprises a wearable headgear 101, a hose 102, and a high-pressure storage tank 103. The wearable headgear 101 comprises an outer layer 104, an insert layer 105, and an inner layer 106, exemplarily illustrated in FIG. 1B. The outer layer 104 comprises a supply port 107. The supply port 107 is in fluid communication with a high-pressure storage tank 103 via a vortex tube 108. In an embodiment, the high-pressure storage tank 103 is mounted on an elastic waistband 401 worn around the waist of the user as exemplarily illustrated in FIG. 4A. The elastic waistband 401 is expandable in nature to be wearable by users of varying hip sizes. In another embodiment, a hip clip is provided to fasten the high-pressure storage tank 103 to the elastic waistband 401. In other embodiments, the high-pressure storage tank 103 is placed in a backpack or a mobility style vest holder. This allows the high-pressure storage tank 103 to be worn or carried around without affecting the user's daily routine. The insert layer 105 is detachably attached to the outer layer 104. The insert layer 105 comprises a network of ducts 109 and a plurality of detachable insert elements 110. The network of ducts 109 is in fluid communication with the supply port 107. The network of ducts 109 receive a cooling gas from the vortex tube 108 and distribute the cooling gas to the hair. The network of ducts 109 are connected and branched throughout the insert layer 105 for air conditioning delivery to the head of the user to help maintain a conducive environment reduced from moisture and heat.

In an embodiment, the high-pressure storage tank 103 stores carbon dioxide ($CO_2$) or air. In case the high-pressure storage tank 103 stores $CO_2$, the $CO_2$ in the high-pressure storage tank 103 exists as a liquid, but when released it turns into a gas. Therefore, by the time the released gas contacts a user's head, the user only feels cool air flow. Alternately, if compressed air is used, the compressed air is in the gaseous state in the high-pressure storage tank 103, not a liquid like $CO_2$. The detachable insert elements 110 are detachably attached to the insert layer 105 via fasteners. In an embodiment, the fasteners used are, for example, snap fasteners, hook and loop fasteners, etc. Each of the detachable insert elements 110 are spaced apart to accommodate the network of ducts 109 therebetween. Further, each of the detachable insert elements 110 comprise desiccant materials embedded within for absorbing moisture. The inner layer 106 detachably attached to the insert layer 105, is made of a breathable material. Moreover, the inner layer 106 is positioned proximal to the hair of the user to transfer the cooling gas to the hair. In an embodiment, a regulator is provided on the high-pressure storage tank 103 to regulate the flow of cooling gas to the network of ducts 109. This allows a user to regulate the cooling supplied to the hair via the network of ducts 109.

Figure 1B:
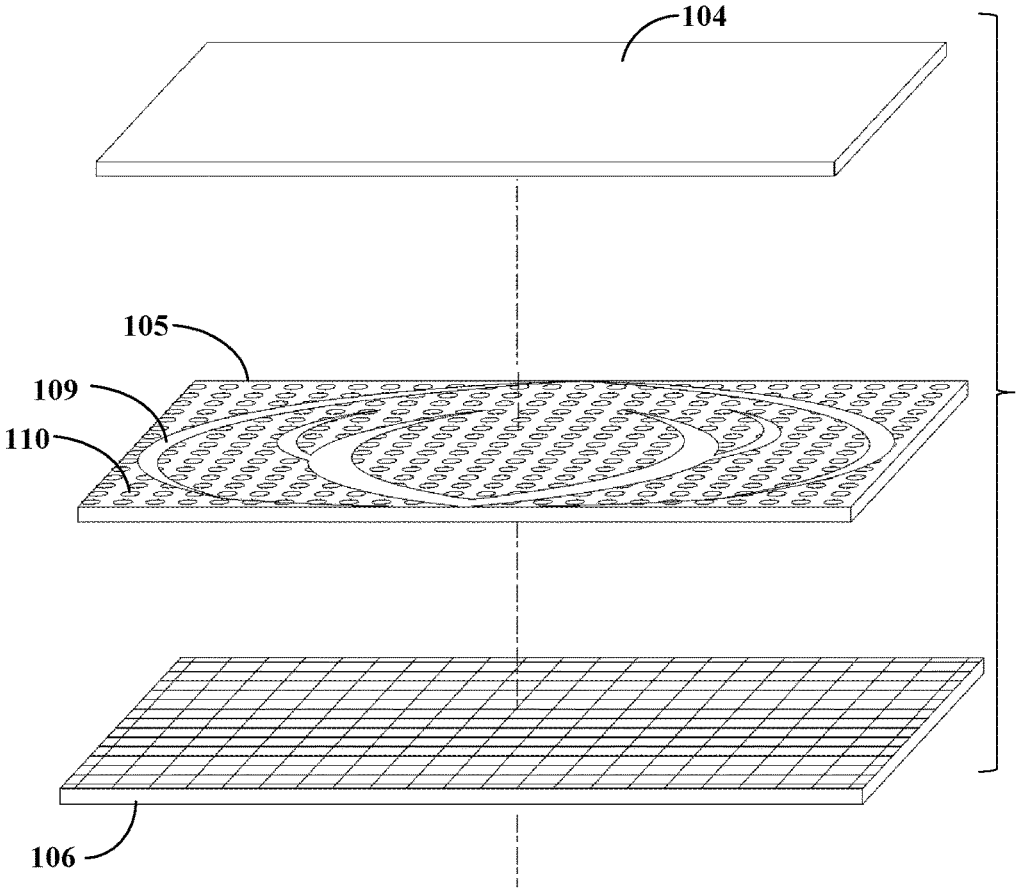
FIG. 1B exemplarily illustrates an exploded view showing layers of a wearable headgear of a hair cooling and dehumidification apparatus.

FIG. 1B exemplarily illustrates an exploded view showing layers of a wearable headgear 101 of a hair cooling and dehumidification apparatus 100 as disclosed in the detailed description of FIG. 1A. The wearable headgear 101, exemplarily illustrated in FIG. 1A, comprises an outer layer 104, an insert layer 105, and an inner layer 106. The inner layer 106 is made of a porous, breathable, absorptive material. The outer layer 104 is made of a breathable, absorptive, athletic performance type of material. The outer layer 104 is available in form fitting or loose fitting variants depending on the user's hairstyle and preference. The outer layer 104 and the inner layer 106 of the wearable headgear 101 enclose the removable insert layer 105. The insert layer 105 is made of a porous, heat resistant, absorptive material, and accommodates the network of ducts 109. The detachable insert elements 110 house the desiccant material, for example, silica gel, etc., to absorb moisture from the hair of the user. In an embodiment, heating coils are provided within the detachable insert elements 110 to heat and remove moisture from the detachable insert elements 110.

Figure 2:
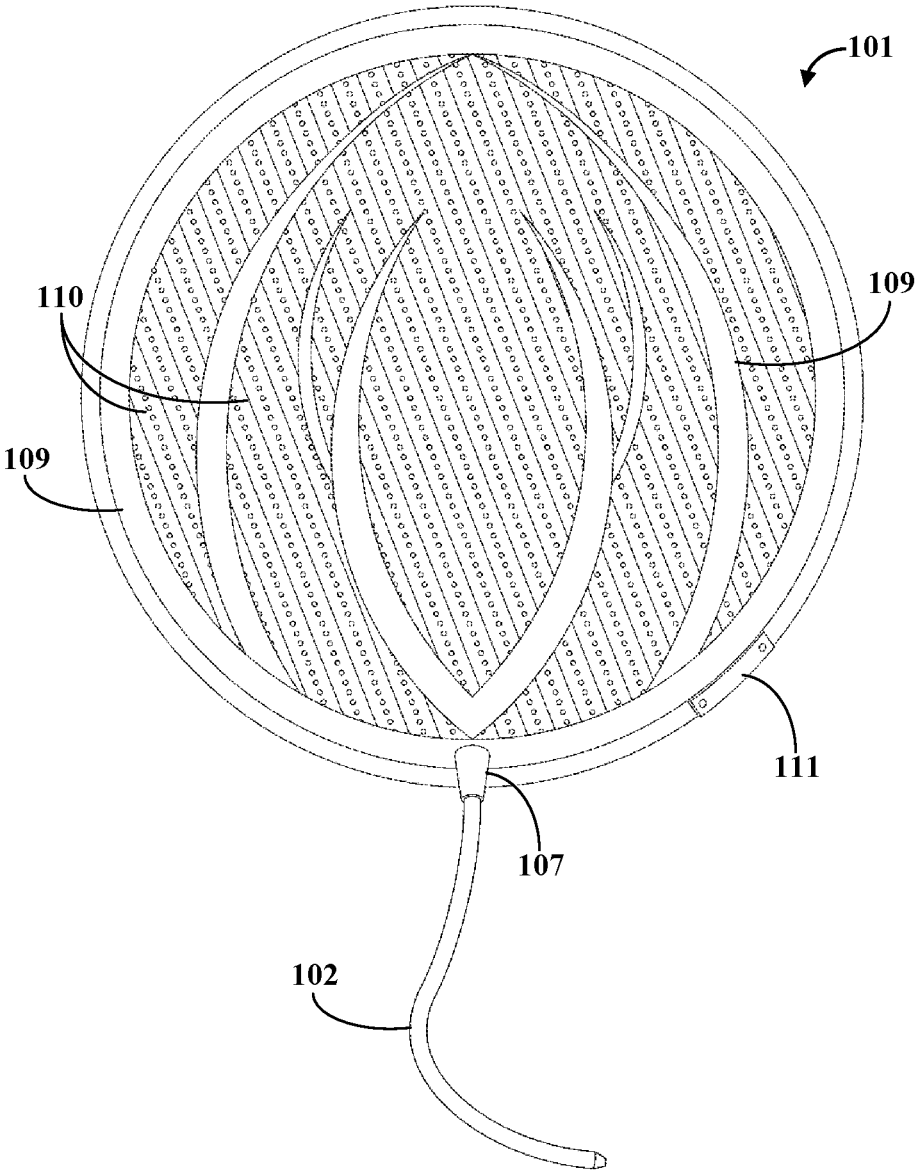
FIG. 2 exemplarily illustrates a bottom plan view of a wearable headgear connected to a hose of a hair cooling and dehumidification apparatus.

FIG. 2 exemplarily illustrates a bottom plan view of a wearable headgear 101 connected to a hose 102 of the hair cooling and dehumidification apparatus 100. In an embodiment, the hose 102 is fastened to the supply port 107 for transferring the cooling gas to the network of ducts 109. In an embodiment, heater elements are provided within the detachable insert elements 110 to remove moisture from the saturated desiccant materials. The desiccant absorbs moisture and changes color when saturated with moisture. In an embodiment, an AC adapter plugged into the charging port 111 of the wearable headgear 101 electrically powers the heater elements. The supply port 107 and the charging port 111 are positioned at the rear of the wearable headgear 101. The network of ducts 109 is in fluid communication with the hose 102 via the supply port 107. The cooling gas received via the hose 102 is distributed throughout the interior of the wearable headgear 101. In an embodiment, the connecting air hose 102 is featured with two male threaded connections at opposing ends of the hose 102. The hose 102 is connected at one end to a source of air flow, for example, a high-pressure storage tank 103, exemplarily illustrated in FIG. 1A.

In an embodiment, the source of the cooling gas can be, for example, a manual air pump, airflow source from a compressor or a CO2/compressed air tank, etc. Further, the airflow source comprises a regulator, which can alter the flow rate delivered to the user's head. In an embodiment, the detachable insert elements 110 fit into the wearable headgear 101. The detachable insert elements 110 are made of a porous material and filled with the desiccant that is used to absorb moisture that builds up between the wearable headgear 101 and the user's hair. In an embodiment, electric heating elements are used to dry out the desiccant after the desiccant has been fully saturated with moisture. The detachable insert elements 110 are removable for the purposes of hand washing and regeneration of the desiccant. The desiccant is reusable and removable from the insert layer 105, exemplarily illustrated in FIG. 1B. In case the desiccant expires its useful life, a new insert layer 105 is used to replace it.

Figure 3A:
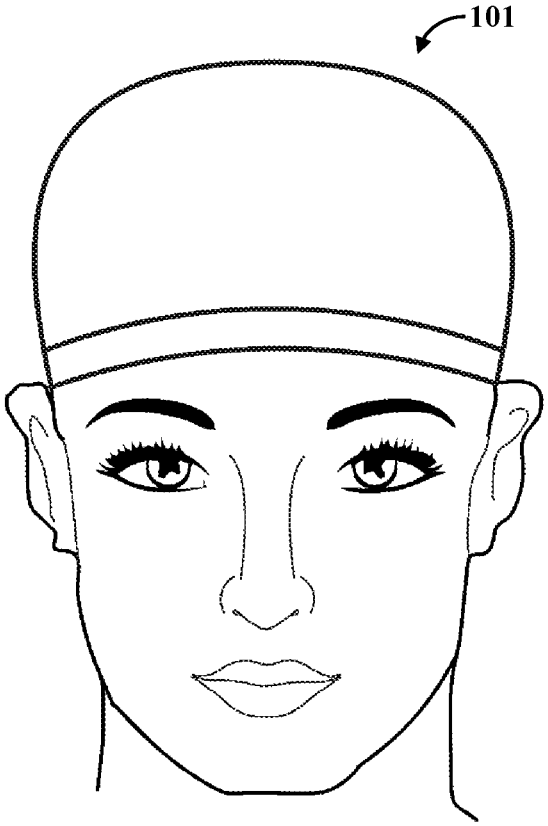
FIG. 3A exemplarily illustrates a front elevation view of a wearable headgear worn by a user.
Figure 3B:
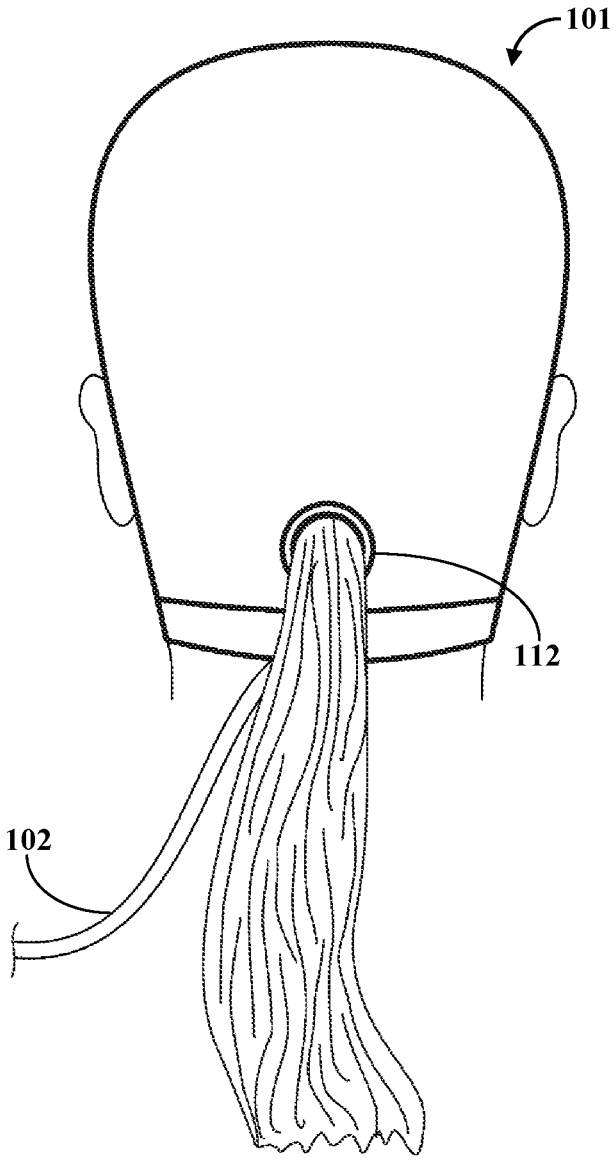
FIG. 3B exemplarily illustrates a rear elevation view of a wearable headgear worn by a user.

FIG. 3A exemplarily illustrates a front elevation view of a wearable headgear 101 worn by a user. FIG. 3B exemplarily illustrates a rear elevation view of a wearable headgear 101 worn by a user. The wearable headgear 101 comprises an adjustable opening 112 positioned at a rear portion of the wearable headgear 101. The hose 102 connects to the wearable headgear 101 to supply cooling gas to the hair of the user as disclosed in the detailed description of FIG. 1A. The adjustable opening 112 is configured to allow the hair of the user to extend through the adjustable opening 112. For a user having a large volume of hair, the adjustable opening 112 is enlarged to allow the hair to extend through the adjustable opening 112.

Figure 4A:
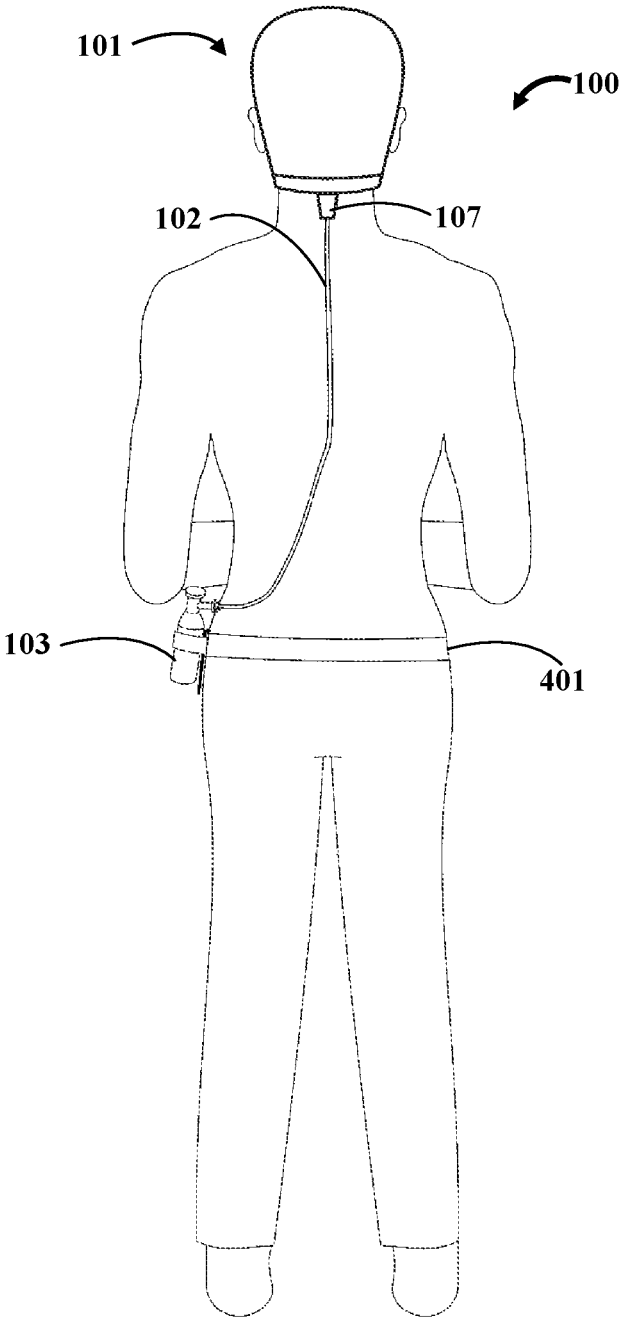
FIG. 4A exemplarily illustrates a rear elevation view of a hair cooling and dehumidification apparatus worn by a user.

FIG. 4A exemplarily illustrates a rear elevation view of a hair cooling and dehumidification apparatus 100 worn by a user. The wearable headgear 101 is worn on the head of the user. The hose 102 is connected to the wearable headgear 101 via the supply port 107 at a first end. A second end of the hose 102 is fastened to the high-pressure storage tank 103. The high-pressure storage tank 103 is mounted on an elastic waistband 401 worn around the waist of the user. In an embodiment, the elastic waistband 401 is expandable in nature to be wearable by users of varying hip sizes. In another embodiment, a hip clip is provided to fasten the high-pressure storage tank 103 to the elastic waistband 401. In other embodiments, the high-pressure storage tank 103 is placed in a backpack or a mobility style vest holder. This allows the high-pressure storage tank 103 to be worn or carried around without affecting the user's daily routine.

Figure 4B:
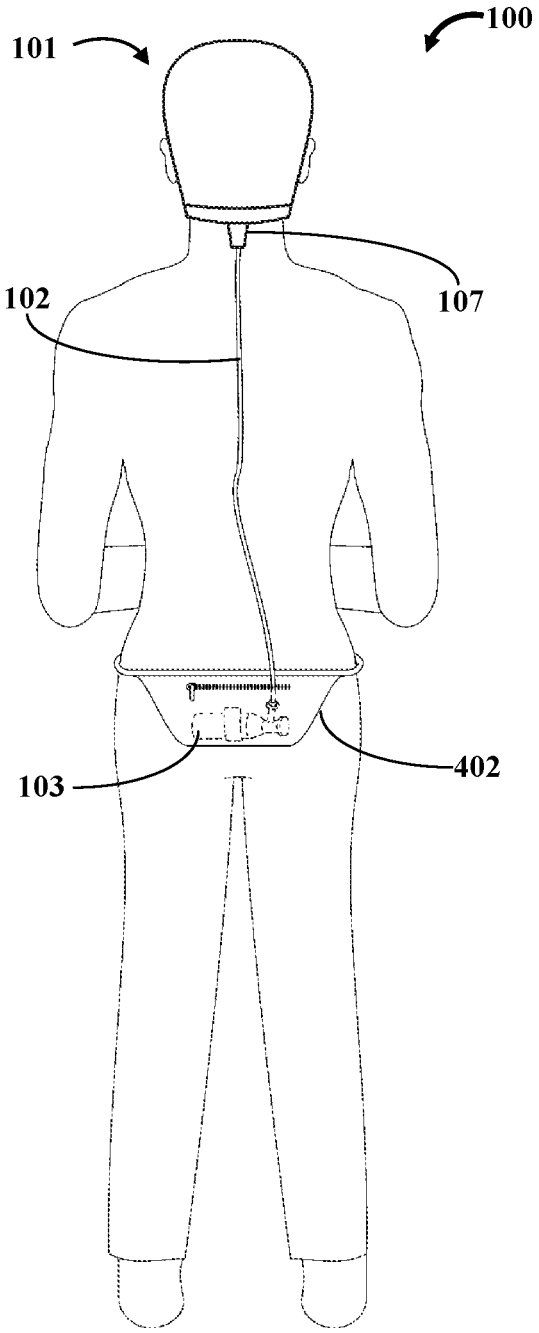
FIG. 4B exemplarily illustrates a rear elevation view of a hair cooling and dehumidification apparatus worn by a user.

FIG. 4B exemplarily illustrates a rear elevation view of a hair cooling and dehumidification apparatus 100 worn by a user. The wearable headgear 101 is worn on the head of the user. The hose 102 is connected to the wearable headgear 101 via the supply port 107 at a first end. A second end of the hose 102 is fastened to the high-pressure storage tank 103. The high-pressure storage tank 103 is housed in a pouch 402 worn around the waist of the user. Any individual who wishes to keep their head from sweating uses the hair cooling and dehumidification apparatus 100. The primary use of the hair cooling and dehumidification apparatus 100 is for women who have natural hair that has been straightened. Alternately, women who have hairstyles that are prone to spoiling due to perspiration created while in a hot, humid environment or while participating in an activity use variants of the hair cooling and dehumidification apparatus 100. In an embodiment, a loose fitting wearable headgear 101 is used if the individual is participating in an activity that involves aggressive body movement. Moreover, the wearable headgear 101 and insert attachments are looser for women who wish to keep their hair from moisture infiltration. This variant of the wearable headgear has an adjustable opening 112 in the rear portion of the wearable headgear 101, as exemplarily illustrated in FIG. 3B, if a woman wants to allow her ponytail to hang out from the adjustable opening 112 in the wearable headgear 101.

The foregoing description comprises illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A hair cooling and dehumidification apparatus for cooling and absorbing moisture of hair of a user, the hair cooling and dehumidification apparatus comprising:

a wearable headgear comprising:

an outer layer comprising a supply port, wherein the supply port is in fluid communication with a high-pressure storage tank via a vortex tube;

an insert layer detachably attached to the outer layer, the insert layer comprising:

a network of ducts in fluid communication with the supply port of the outer layer, wherein the network of ducts receive a cooling gas from the vortex tube and distribute the cooling gas to the hair;

a plurality of detachable insert elements detachably attached to the insert layer via fasteners, wherein the each of the detachable insert elements are spaced apart to accommodate the network of ducts there between, and wherein each of the detachable insert elements comprise desiccant materials embedded within for absorbing moisture; and, an inner layer detachably attached to the insert layer, wherein the inner layer is of a breathable material positioned proximal to the hair of the user to transfer the cooling gas to the hair.

2. The hair cooling and dehumidification apparatus of claim 1, wherein a hose is fastened to the supply port and the high-pressure storage tank via the vortex tube for transferring the cooling gas to the network of ducts.

3. The hair cooling and dehumidification apparatus of claim 1, further comprising a plurality of heater elements positioned within the detachable insert elements, wherein the heater elements are configured to remove moisture absorbed by the desiccant materials.

4. The hair cooling and dehumidification apparatus of claim 3, wherein the heater elements are electrically powered by an AC adapter plugged into a charging port positioned at a rear portion of the wearable headgear.

5. The hair cooling and dehumidification apparatus of claim 1, further comprising an adjustable opening positioned at a rear portion of the wearable headgear, wherein the adjustable opening is configured to allow the hair of the user to extend through the adjustable opening.

6. The hair cooling and dehumidification apparatus of claim 1, wherein the outer layer is of a breathable material.

7. The hair cooling and dehumidification apparatus of claim 1, wherein the detachable insert elements are of a washable material.

* * * * *